United States Patent [19]

Bidoia

[11] Patent Number: 4,616,524

[45] Date of Patent: Oct. 14, 1986

[54] COMPACT SIZE ACTUATING KNOB FOR ADJUSTING AND CLOSURE DEVICES, PARTICULARLY IN SKI BOOTS

[75] Inventor: Vincenzo Bidoia, Castelfranco Veneto, Italy

[73] Assignee: Nordica S.p.A., Montebelluna, Italy

[21] Appl. No.: 707,620

[22] Filed: Mar. 4, 1985

[30] Foreign Application Priority Data

Mar. 14, 1984 [IT] Italy ..... 21234/84[U]

[51] Int. Cl.[4] ..... G05G 1/10

[52] U.S. Cl. ..... 74/553; 16/121; 36/120

[58] Field of Search ..... 74/553; 16/121; 36/120

[56] References Cited

U.S. PATENT DOCUMENTS 2,482,348 9/1949 Laud ..... 16/121 X

*Primary Examiner*—Harold W. Weakley

*Attorney, Agent, or Firm*—Guido Modiano; Albert Josif

[57] ABSTRACT

The actuating knob comprises a body of substantially cylindrical configuration and at least one wing supported on the body for rotation about a substantially parallel axis to the axis of said body. The, at least one wing being positionable at a home position, whereat it is contained within the outline of the body. The, at least one wing also being positionable at an operative position, whereat it protrudes substantially radially from the body to increase the working diameter thereof.

6 Claims, 4 Drawing Figures

COMPACT SIZE ACTUATING KNOB FOR ADJUSTING AND CLOSURE DEVICES, PARTICULARLY IN SKI BOOTS

BACKGROUND OF THE INVENTION

This invention relates to a compact size actuating knob for adjusting and closure devices, particularly in ski boots.

As is known, ski boots are currently fitted with adjusting devices or closure devices which are operated by means of a length of cable wound around a spool or the like, which cable is actuated from a knob mounted on the boot outer surface.

In order to enable one to apply sufficient tightening torque for obtaining the required tension in the cable, the knob must be provided in a very large size, specifically a large diameter.

On the other hand, the use of a large diameter knob is made impossible both for aesthetic reasons and by virtue of the fact that a large diameter knob cannot be incorporated to the boot in practice without presenting an inconvenient encumbrance for the user.

In an effort to solve the problem, the size of knobs currently in use is practically dictated by a compromised solution which provides a knob sized to avoid both excessive bulk of the boot and to enable one to apply an adequate tightening torque.

SUMMARY OF THE INVENTION

It is the aim of this invention to obviate such prior problems by providing and actuating knob which, while having much reduced overall dimensions, enables application, of a very high tightening torque, for a given power, whereby a desired degree of tightening can be achieved in the adjusting device or closure device with a knob which would not be a hindrance on the outside of the boot or aesthetically unappealing.

Within the above aim, it is a particular object of the invention to provide an actuating knob which, while affording greatly improved functional characteristics, has a simplified construction which leaves the construction and operation principles currently employed knobs practically unaltered.

Another object of this invention is to provide an actuating knob which, owing to its peculiar construction, can give full assurance of being reliable and safe to use.

It is a further object of this invention to provide an actuating knob which is highly convenient to use and versatile, as well as being of relatively low cost.

The above aim, as well as these and other objects such as will be apparent hereinafter, are achieved by an actuating knob for adjusting and closure devices, particularly in ski boots, according to the invention, comprising a body of substantially cylindrical configuration, and characterized in that it comprises at least one wing supported on said body for rotation about a substantially parallel axis to the axis of said body, said at least one wing being positionable at a home position, whereat it is contained within the outline of said body, and at an operative position, whereat it protrudes substantially radially from said body to increase the working diameter thereof.

BRIEF DESCRIPTION OF THE DRAWINGS

Further features and advantages will become apparent from the following detailed description of an actuating knob for adjusting and closure devices, particularly in ski boots, as illustrated by way of example and not of limitation in the accompanying drawing, where.

DESCRIPTION OF THE PREFERRED EMBODIMENTS

Figure 3:
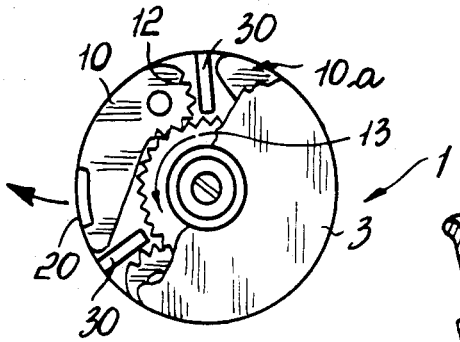
FIG. 3 is a partly cut-away front view of this actuating knob with the wing in its home position.

With reference to the cited drawing figures, this actuating knob for adjusting and closure devices, particularly in ski boots, comprises a body, generally designated with the reference numeral 1, which has a mainly cylindrical configuration and is supported rotatably on the outer surface of a ski boot, generally designated with the reference numeral 2.

A peculiar aspect of the invention resides in that, on the base or end 3 of the cylindrical body 1, there are mounted wings, indicated at 10, for rotation about substantially parallel axes to the axis of the cylindrical body 1.

In this specific embodiment, three such wings are provided which are mounted circumferentially at regular intervals, but it would obviously be possible to change the number of the wings without deviating from the concept underlying this invention.

Specifically, the wings 10 are formed, at their areas of pivotal connection, with a projection 11 formed with a peripheral serration 12 meshing with a toothed ring 13 which lies coaxial with the body 1 and in practice serves the function of synchronizing the rotation of the individual wings.

Provided on one of the wings 10, is a grip lug 20 positioned substantially on the lateral surface of the body 1 close to the base 3, and in closed position, set flush with the outer lateral surface of the cylindrical body 1, said grip lug being adapted for actuation of the wings 10. For the purpose lug 20 slightly projects beyond the surface of end or base 3.

Furthermore, abutment partitions, indicated at 30, are provided which function as a detent and bearing element for the wings 10 when the latter are brought to a radial working position.

Figure 2:
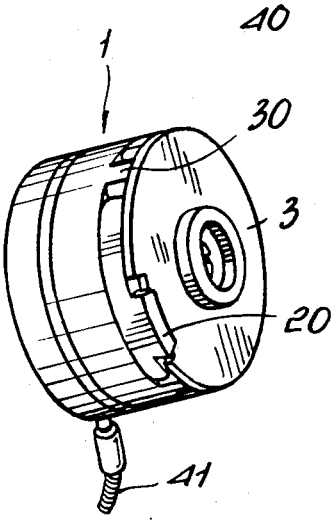
FIG. 2 shows the actuating knob with the wing in its home position, in perspective view.
Figure 4:
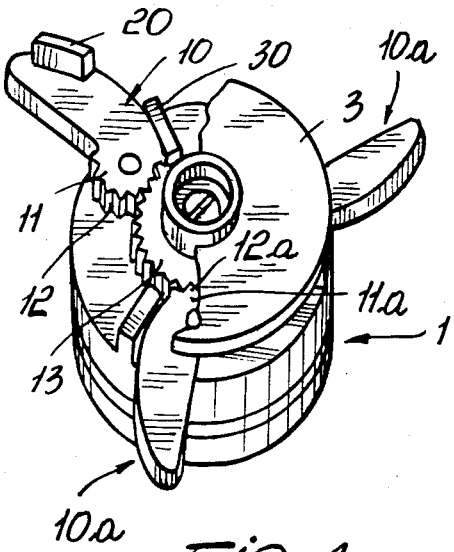
FIG. 4 is a partly cut-away perspective view of this knob with the wing in its operative position.

The wings 10 may be positioned at a home position, shown in FIGS. 2 and 3, whereat the wings are flush with the outer lateral surface of the body 1, and accordingly, do not protrude from the outline of the body 1.

Figure 1:
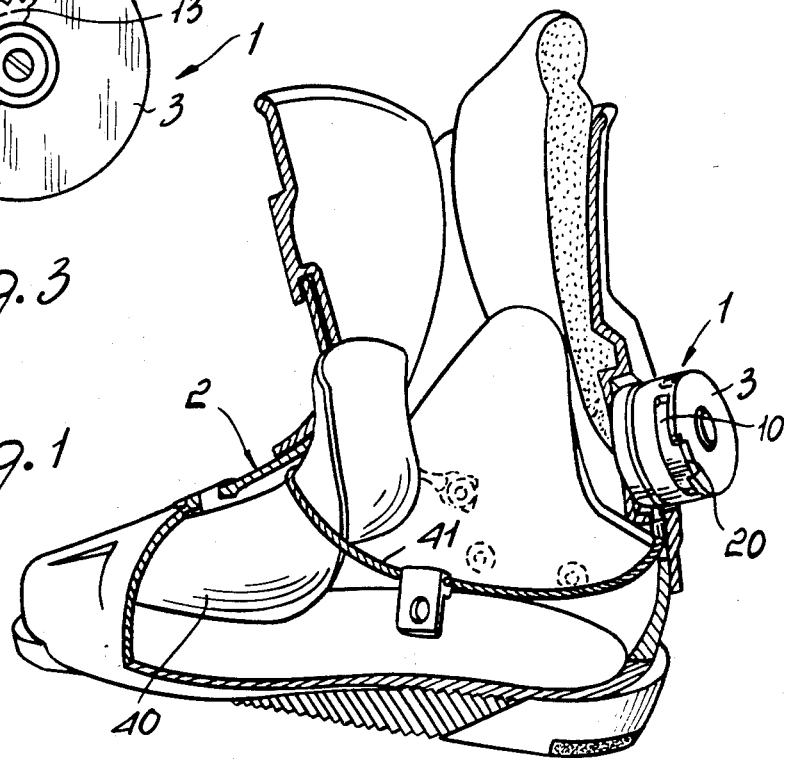
FIG. 1 is a perspective view showing diagramatically an actuating knob according to the invention, as incorporated to a ski boot depicted in a cut-away view.

When the knob is to be operated, for example, to actuate an adjusting device such as the foot instep presser 40 shown in FIG. 1, the user should turn the knob in a clockwise direction to take up cable, around the spool connected to the knob, said cable extending inside the sheath 41 which overlies the presser 40.

To carry out this operation, it is necessary that the user be enabled to apply an adequate desired tightening force to the cable without any excessive effort.

To this end, it will be sufficient for the user to pull out the wing 10 having the lug 20 to simultaneously extend the other wings by virtue of their interconnection through the toothed ring 13.

The wings, when set radially outwards from the lateral surface of the cylindrical body, in their working position, practically increase to a significant extent the diameter of the body 1, thereby enabling a high tightening torque to be developed.

The wings 10, 10*a* can be located at said working position by acting on said grip lug 20, effective to rotate the wing 10 associated therewith about its own axis, lying substantially parallel to the axis of the cylindrical body 1, thus causing rotation of the projection 11, provided at the opposite end of said wing 10 to said grip lug 20 and formed with peripheral serrations 12.

By virtue of the fact that the peripheral serrations 12 are in mesh engagement with a toothed ring 13, said rotation of said projection 11 imparts rotary motion to said toothed ring 13, which rotates about its own axis lying coaxial with said body 1.

The resultant rotary motion of the toothed ring 13 in turn, simultaneously imparts uniform rotary motion to other projections 11*a*, associated with other wings 10*a*, through peripheral serrations 12*a*, formed thereon in mesh engagement with said toothed ring 13, thereby causing said other wings 10*a* to be simultaneously, uniformly rotated as said grip lug 20 associated with said wing 10 is activated.

The simultaneous rotation of said wings 10, 10*a* about their axes may be continued until they engage with the abutment partitions 30, at which location, said wings 10, 10*a* are set radially outwards from said lateral surface of said cylindrical body 1 in an operative or working position.

After the knob has been operated in accordance with the knob operating procedure, the operator can return the wings to within the body 1 by merely acting on just one wing, thereby the overall diameter of the body 1 is greatly reduced.

It may be appreciated from the above description that the invention achieves its objects, and in particular, the fact should be pointed out that, while the diameter and overall dimensions of the knob have been much reduced, a high tightening torque can be developed thanks to the provision of the wings 10 which are readily and quickly extended to confer a much larger working diameter to the body.

The provision of the toothed ring 13 interconnecting the wings 10 through mesh engagement with peripheral serrations 12 formed on the projection 11 of each wing affords, moreover, a synchronous movement of all the wings, thus making operation of the knob much easier.

In practicing the invention, any materials, dimensions and contingent shapes may be selected and used, to meet individual requirements as long as compatible with the specific application.

What is claimed is:

1. An actuating knob for adjusting and closure devices, particularly in ski boots, comprising a body of substantially cylindrical configuration, characterized in that it comprises at least one wing supported on said body for rotation about a substantially parallel axis to the axis of said body, said at least one wing being positionable at a home position, whereat it is contained within the outline of said body, and at an operative position, whereat it protrudes substantially radially from said body to increase the working diameter thereof.

2. An actuating knob for adjusting and closure devices, according to claim 1, characterized in that it comprises a plurality of said wings distributed circumferentially at regular intervals on said body.

3. An actuating knob for adjusting and closure devices, according to claim 1, characterized in that said wings are formed, at the area of pivotal connection thereof, with a projection having a peripheral serration engaging with a toothed ring carried rotatably coaxially with said knob and adapted to engage with the serrated portions of the remaining wings for a synchronous movement of said wings.

4. An actuating knob for adjusting and closure devices, according to claim 1, characterized in that, in said home position, said wings are positioned substantially flush with the lateral surface of said body.

5. An actuating knob for adjusting and closure devices, according to claim 1, characterized in that at least one of said wings has a gripping lug set flush with the outside of said body.

6. An actuating knob for adjusting and closure devices, according to claim 1, characterized in that it comprises abutment partitions adapted to abut said wings as placed in said operative position.

* * * * *